United States Patent [19]

Mandrin

[11] Patent Number: 5,025,860

[45] Date of Patent: Jun. 25, 1991

[54] METHOD AND APPARATUS OF OBTAINING NATURAL GAS FROM A MARITIME DEPOSIT

[75] Inventor: Charles Mandrin, Winterthur, Switzerland

[73] Assignee: Sulzer Brothers Limited, Winterthur, Switzerland

[21] Appl. No.: 500,749

[22] Filed: Mar. 28, 1990

[30] Foreign Application Priority Data

Apr. 17, 1989 [CH] Switzerland ..... 1445/89

[51] Int. Cl.[5] ..... E21B 43/01

[52] U.S. Cl. ..... 166/267; 62/48.2

[58] Field of Search ..... 166/267, 210, 53; 62/47.1, 48.2, 48.1, 53.2; 137/236.1, 615

[56] References Cited

U.S. PATENT DOCUMENTS

| | | | |
|---|---|---|---|
| 2,355,167 | 8/1944 | Keith | 166/267 X |
| 2,588,296 | 3/1952 | Russell, Jr. | 166/267 X |
| 3,011,321 | 12/1961 | Clarson | 62/53.2 |
| 4,613,338 | 9/1986 | Rogers et al. | 166/267 X |
| 4,664,190 | 5/1987 | Carpentier | 166/267 |
| 4,727,723 | 3/1988 | Durr | 62/48.2 |
| 4,898,006 | 2/1990 | Fencl et al. | 62/48.2 |

*Primary Examiner*—William P. Neuder

*Attorney, Agent, or Firm*—Kenyon & Kenyon

[57] ABSTRACT

The natural gas which is obtained from a maritime deposit is purified on a platform or ship and is then compressed and cooled while on the platform or ship before being delivered under pressure to a LNG tanker where liquefaction takes place by expansion. An expansion group is disposed on the tanker in order to obtain liquefied natural gas at approximately 1 bar while non-liquified residual gases are returned to the platform or ship via a return line.

13 Claims, 1 Drawing Sheet

METHOD AND APPARATUS OF OBTAINING NATURAL GAS FROM A MARITIME DEPOSIT

Figure 1:
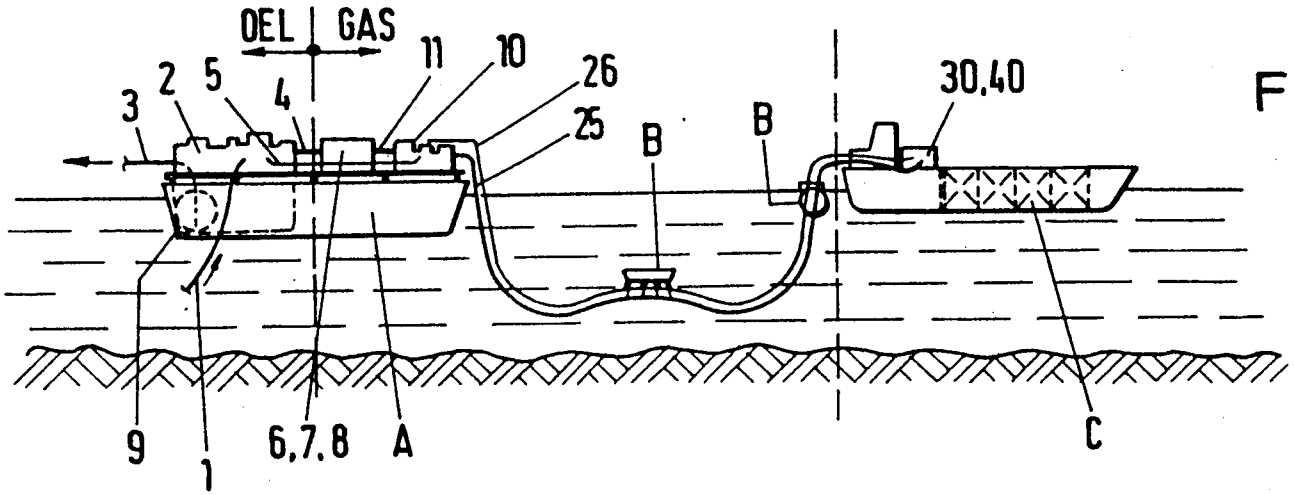

This invention relates to a method and apparatus of obtaining natural gas from a maritime deposit.

Heretofore, it has been known to obtain an unpurified natural gas from a maritime deposit on board a production platform or production ship. In such cases, the unpurified gas is usually de-acidified and/or purified of carbon dioxide and water and sent to an LNG tanker for liquefaction by the Joule-Thomson effect.

Natural-gas rigs and the associated handling techniques are described in Erd81-Erdgas-Zeitschrift (URBAN-Verlag, Neumann-Reichardtstr. 34, D-2000 Hamburg as follows:

Offshore-Erdgasverflussigung in der Nordsee Volume 93, August 1977, pages 268–271;

LNG-Transfersystem als Verbindungsleitung zweier schwimmenden Einheiten einer Offshort-Erdgasverflussigungsanlage, Volume 93, August 1977, pages 277–282;

Erdgasverflussigungsanlagen auf Produktionsplattformen fur die Nordsee, Volume 96, November 1980, pages 409–413, and Nutzung marginaler Erdgasvorkommen mit nennenswerten NGL-Anteil durch erdgasverflussigung und OffshoreTankerverladung, Volume 97, September 1981, pages 314–320.

Also, DE-A-32 00 958 discloses a method of obtaining natural gas from maritime deposits wherein the gas is liquefied completely on an LNG tanker. In this case, pressure-increasing and cooling systems are supplied by the energy system of the LNG tanker or by a source of energy installed thereto. However, this places limitations on the economic filling of tankers, since either the production rates will be slow and the filling times will be long, or every LNG tanker would be equipped with energy sources which are above the dimensions required for propulsion power. Furthermore, there is no disclosure regarding the subsequent treatment on the LNG tanker of non-liquefied gas constituents such as nitrogen and methane.

In the present economic situation, there are more than enough LNG tankers available throughout the world, and also there are much higher environmental requirements on oil production. Some countries, for example, have recently prohibited the burning-off of flash gas on oil platforms at sea. Thus platforms producing e.g. 1500 cubic meters of oil per hour and having to dispose of 200 tons/hour of flash gas, may no longer be viable if there is no possibility of re-injection into the oil field or through gas pipelines to the mainland.

Accordingly, it is an object of the invention to economically obtain liquefied natural gas from a maritime deposit.

It is another object of the invention to provide a relatively simple technique of storing purified flash gas in liquid form at atmosphere pressure in already available LNG tankers.

It is another object of the invention to provide an economic method of utilizing flash gas obtained during the extraction of oil from a maritime deposit.

Briefly the invention provides a method of obtaining natural gas from a maritime deposit. In this respect, a flow of natural gas from a maritime deposit is obtained on board one of a platform ship. Thereafter, the flow of natural gas is de-acidified and purified of carbon dioxide and water. In accordance with the invention, the flow of natural gas is then compressed gaseous and cooled to a compressed state on board the platform or ship and subsequently delivered to a liquid natural gas (LNG) tanker. In addition, non-liquefied natural gas from the flow of pressurized natural gas delivered to the tanker is returned from the tanker to the platform or ship.

The invention also provides a system wherein the platform or ship is provided with a production unit for obtaining natural gas from a flow of crude oil from a maritime deposit, means for purifying the natural gas of at least one of acid, carbon dioxide and water and a compression and cooling unit for compressing and cooling the purified natural gas. The tanker is provided with an expansion group for receiving and expanding a flow of pressurized natural gas from the compression and cooling unit on the platform or ship in order to expand the natural gas to form liquefied natural gas while generating non-liquefied residual natural gas. In addition, at least one compressor is provided on the tanker for compressing the residual gas for return to the platform or ship.

In addition to the above, a suitable high-pressure line is provided, for example on the platform or ship for delivering the pressurized natural gas to the expansion group on an LNG tanker.

In accordance with the invention, the pressures and temperatures needed for liquefaction by pre-cooling and expansion in the case of a stream of pure gas are already generated by the output from energy producers on the platform or ship before the gas is sent through the high-pressure supply line to the LNG tanker.

The advantages of the invention are, firstly, that energy, for subsequent liquefaction is already used up on the platform or ship, and the investment for the required plant has to be made only once, irrespective of the number and size of the LNG tankers. Secondly, the use of LNG tankers is economically justified, even if for a limited time, since the alterations to the plant can be made on the upper deck of the ships, using skids which can be dismantled later.

The natural gas can come either from a source thereof or as a by-product from an oil well.

Figure 2:
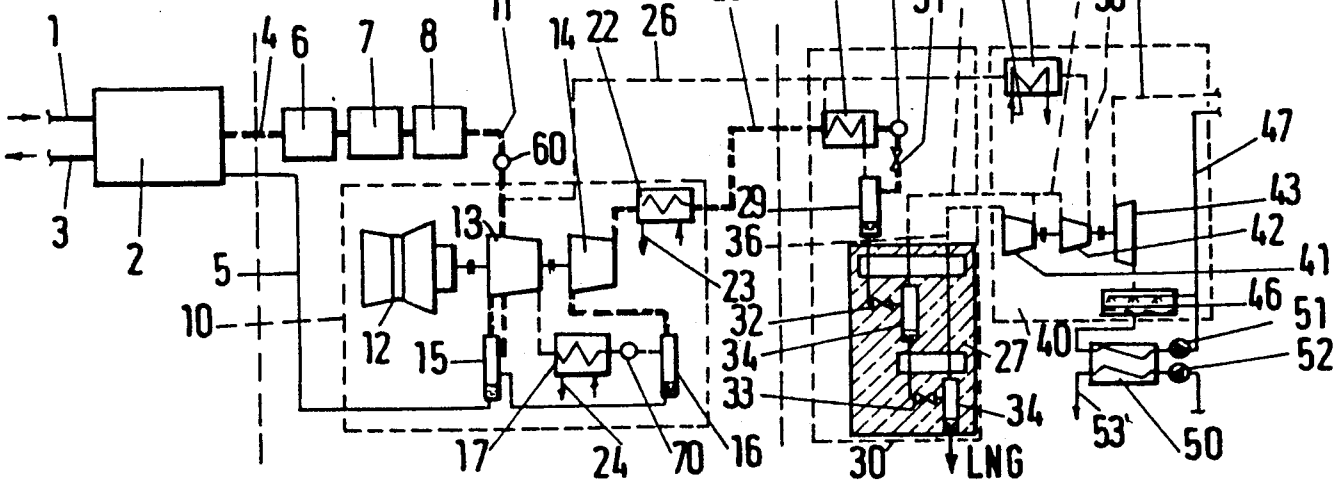

These and other objects and advantages of the invention will become more apparent from the following detailed description taken in conjunction with the accompanying drawings wherein:

FIG. 1 diagrammatically illustrates a system constructed in accordance with the invention; and FIG. 2 illustrates a flow chart of the method of obtaining natural gas processed in accordance with the system of FIG. 1.

Referring to FIG. 1, the system for obtaining natural gas from a maritime deposit employs a platform or ship A located above a sea bed and at least one LNG tanker C.

As illustrated, a line 1 supplies crude oil accompanied by gas to a production unit 2 on the platform A. The production unit is of known construction and serves to process the oil while discharging the oil through a line 3 after temporary storage in a tank 9. The production unit 2 is also connected via a line 4 to a means 6, 7, 8 for purifying a flow of natural gas of acid, carbon dioxide and water. To this end, as illustrated in FIG. 2, a suitable unit 6 is provided for removing carbon dioxide, a unit 7 is provided for deacidification of the gas, if necessary, and a dehydration unit 8 is provided for removing water.

A compression and cooling unit 10 is also disposed on the platform or ship A downstream of the dehydration unit 8 and receives a flow of purified natural gas via a line 11.

The tanker C is provided with an expansion group 30 and a compressor group 40 including at least one compressor.

The compression and cooling unit 10 on the platform or ship A is connected by a high pressure line 25 to the expansion group 30 on the tanker C. As indicated, the line 25 may be guided by floats or buoys B.

The operation of the system will be described with reference to FIG. 2.

After being purified on the platform A, the flow of natural gas is passed via the line 11 into the compression and cooling unit 10. As illustrated, this unit 10 includes an energy generator 12 which is normally disposed on the platform A and which supplies the power for operating the unit 10. In addition, a pair of compressors 13, 14 are driven by the energy generator 12 and are disposed in the flow path of the natural gas in order to compress the natural gas. The pressure reached at the compressor outlet must be sufficient for subsequent pressure drips in transfer lines and for liquefaction by expansion. Still further a liquid separator 15 is connected to the first compressor 13 in order to separate liquid constituents from the flow of natural gas, for example for return via a return line 5 to the production unit 2. A cooler 17 is also connected between the compressors 13, 14 for cooling the natural gas. A second liquid separator 16 is disposed between the cooler 17 and the compressor 14 in order to again separate out any liquid constituents for return to the production unit 2 via the first liquid separator 15 and the return line 5. Still further, a second cooler 22 is disposed downstream of the compressors 13, 14 for further cooling of the gas for subsequent delivery to the expansion group 30 of the tanker C.

As illustrated in FIG. 2, each of the coolers 17, 22 is provided with a circuit 23, 24 (shown schematically) for cycling a coolant through each for heat exchange with the gas passing through the coolers 17, 22.

Still further, evaporators 60, 70 are disposed within the flow path of the natural gas for withdrawing heat from the gas sufficient to precipitate heavy components therefrom.

The expansion group 30 which is mounted on the tanker C may form a self-supporting sub-assembly secured to an upper deck of the tanker so as to be readily mounted in place or removed. The expansion group 30 substantially comprises a pre-cooler 28 followed by an expansion stage 31 and a liquid separator 29 which uses the gaseous constituent as a cooling medium and by supplying the medium through the pre-cooler 28 to a return line 26. As indicated in FIG. 1, the return line 26 may also be supported by the floats and buoys B. Also, as indicated in FIG. 2, the return line 26 communicates with the line 11 which feeds the natural gas to the first compressor 13 of the compression and cooling unit 10. The liquid constituent from the liquid separator 29 is delivered to a refrigerator 27 which, in this case, comprises two expansion stages 32, 33 followed by separators 34 and from which liquefied natural gas is withdrawn.

As indicated, the expansion group 30 also includes an evaporator 80 in the flow of pressurized natural gas for withdrawing heat from the gas. In addition, a pair of supply lines 36, 37 are connected to the separators 34 in order to exhaust non-liquefied residual gases from the refrigerator 27 to the compressor unit 40.

As illustrated, the compressor unit 40 includes a pair of compressors 41, 42 which draw off the non-liquefied residual gases from the supply lines 36, 37. As indicated, a line 39 communicates the upstream compressor 41 with the downstream compressor 42 for conveying compressed residual gas therebetween. The downstream compressor 42, in turn is connected via a line 38 to an aftercooler 48 which is supplied with a cooling medium via a suitable circuit 49 for cooling of the residual gases. The aftercooler 48 is, in turn, connected with the return line 26 for supplying the compressed and cooled residual gas to the compression and cooling unit 10 on the rig A.

As illustrated, a back pressure turbine 43 is used to drive the compressors 41, 42 of the compressor unit 40 in order to keep the space required for wet steam lines and a condensor 46 within reasonable limits. Steam is supplied by a steam boiler of the tank C through a line 44. Condensate from the turbine 43 is sub-cooled by a liquid cooling medium 53 in a condensate cooler 50. As indicated, a condensate pump 51 delivers the condensate through a line 47 back to the steam boiler while a separate liquid pump 52 conveys the cooling medium 53 through the cooler 50.

During operation, the pressures and temperatures needed for liquefaction by the Joule-Thomson effect on the tanker C are imparted to the flow of natural gas by the compression and cooling unit 10 on rig or ship A.

The expansion group 30 serves to produce liquefied natural gas at a pressure of about 1 bar.

The non-liquefied residual gases which are compressed and cooled by the compressor group 40 are returned at approximately 30 bar to the rig A via the return line 26.

In the respect, the residual gases may be delivered to a combustion chamber of a gas turbine 12 used for driving the compressors 13, 14 of the compression and cooling unit 10 on the rig or ship A.

The invention thus provides a relatively simple economic technique for utilizing flash gas obtained from a maritime deposit of crude oil. Further, the invention provides an economic manner of obtaining natural gas from a maritime deposit.

Still further, the invention provides a simple economic manner of using LNG tankers for the storage of liquefied natural gas from a maritime deposit.

I claim:

1. A method of obtaining natural gas from a maritime deposit, said method comprising the steps of obtaining a flow of natural gas from a maritime deposit on board one of a production platform and a production ship;

purifying the flow of natural gas of at least one of acid, carbon dioxide and water;

thereafter compressing and cooling the flow of natural gas to a compressed state on board the selected one of the platform and ship;

subsequently delivering the flow of compressed natural gas to a LNG tanker; and expanding the flow of compressed natural gas on the tanker to form liquefied natural gas;

storing the liquefied natural gas on the tanker; and returning non-liquefied natural gas from the flow of natural gas delivered to the tanker from the tanker to the selected one of the platform and ship.

2. A method as set forth in claim 1 wherein the flow of natural gas from the maritime deposit is obtained by separation of natural gas from a flow of crude oil from the maritime deposit.

3. A method as set forth in claim 1 wherein the flow of natural gas is delivered to the tanker in a pressurized line.

4. The combination of a platform;

a production unit on said platform for obtaining natural gas from a flow of crude oil from a maritime deposit;

means on said platform for purifying the natural gas of at least one of acid, carbon dioxide and water;

a compression and cooling unit on such platform for compressing and cooling the purified natural gas; and a high-pressure line for delivering the pressurized natural gas to an LNG tanker.

5. The combination as set forth in claim 4 wherein said compression and cooling unit includes a compressor for generating a pressure for the gas conveyed in said line sufficient to permit subsequent liquefaction by expansion.

6. A system for obtaining natural gas from a maritime deposit, and system comprising a platform;

a production unit on said platform for obtaining natural gas from a flow of crude oil from a maritime deposit;

means on said platform for purifying the natural gas of at least one of acid, carbon dioxide and water;

a compression and cooling unit on said platform for compressing and cooling the purified natural gas;

at least one tanker for storing liquefied natural gas;

an expansion group on said tanker for receiving and expanding a flow of pressurized natural gas from said compression and cooling unit on said platform to expand the natural gas to form liquefied natural gas while generating non-liquefied residual natural gas; and at least one compressor on said tanker for compressing the residual gas for return to said platform.

7. A system as set forth in claim 6 wherein said compression and cooling unit includes at least one compressor for compressing a flow of natural gas and a gas turbine drivingly connected to said one compressor and having a combustion chamber for receiving the residual gas from said compressor on said tanker.

8. A system as set forth in claim 6 which further comprises a turbine on said tanker drivingly connected to said compressor and disposed for receiving steam from a steam boiler on said tanker.

9. A system as set forth in claim 6 wherein said expansion group includes a refrigerator for receiving a flow of pressurized natural gas and at least one expansion stage in said refrigerator for expanding the flow of natural gas.

10. A system as set forth in claim 9 which further comprises at least one evaporator in the flow of the natural gas on said tanker for withdrawing heat from the gas.

11. A system as set forth in claim 6 wherein each of said expansion group and said compressor is a self-supporting sub-assembly secured to an upper deck of said tanker.

12. A system as set forth in claim 6 which further comprises at least one evaporator in the flow of the natural gas on said platform for withdrawing heat from the gas sufficient to precipitate heavy components therefrom.

13. A system for obtaining natural gas from a maritime deposit, and system comprising a ship;

a production unit on said ship for obtaining natural gas from a flow of crude oil from a maritime deposit;

means on said ship for purifying the natural gas of at least one of acid, carbon dioxide and water;

a compression and cooling unit on such ship for compressing and cooling the purified natural gas;

at least one tanker for storing liquefied natural gas;

an expansion group on said tanker for receiving and expanding a flow of pressurized natural gas from said compression and cooling unit on said ship to expand the natural gas to form liquefied natural gas while generating non-liquefied residual natural gas; and at least one compressor on said tanker for compressing the residual gas for return to said ship.

* * * * *

UNITED STATES PATENT AND TRADEMARK OFFICE

CERTIFICATE OF CORRECTION

PATENT NO. : 5,025,860

DATED : June 25, 1991

INVENTOR(S) : CHARLES MANDRIN

It is certified that error appears in the above-identified patent and that said Letters Patent is hereby corrected as shown below:

Column 1, line 16 change "burg" to -burg 70) -

Column 1, line 67 change "platform" to -platform or-

Column 3, line 24 change "drips" to -drops-
Column 4, line 31 change "rig" to -platform-
Column 4, line 36 change "rig" to -platform-
Column 4, line 41 change "rig" to -platform-

Signed and Sealed this

Second Day of March, 1993

*Attest:*

STEPHEN G. KUNIN

*Attesting Officer*

*Acting Commissioner of Patents and Trademarks*